US006684921B2

(12) United States Patent
Tatsuno

(10) Patent No.: US 6,684,921 B2
(45) Date of Patent: Feb. 3, 2004

(54) LIQUID SUPPLY NOZZLE

(75) Inventor: Hiyoshi Tatsuno, Tokyo (JP)

(73) Assignee: Tatsuno Corporation, Tokyo (JP)

( * ) Notice: Subject to any disclaimer, the term of this patent is extended or adjusted under 35 U.S.C. 154(b) by 90 days.

(21) Appl. No.: 09/960,350

(22) Filed: Sep. 24, 2001

(65) Prior Publication Data

US 2002/0189708 A1 Dec. 19, 2002

(30) Foreign Application Priority Data

Jun. 13, 2001 (JP) ..... 2001-178668

(51) Int. Cl.[7] ..... B65B 3/18

(52) U.S. Cl. ..... 141/217; 141/94; 141/206; 141/225

(58) Field of Search ..... 141/206–229, 141/94

(56) References Cited

U.S. PATENT DOCUMENTS 3,823,752 A * 7/1974 Lasater et al. ..... 141/217
4,497,350 A * 2/1985 Guertin ..... 141/206
5,577,538 A * 11/1996 Sunderhaus et al. ..... 141/94
6,024,140 A * 2/2000 Garrison et al. ..... 141/59

FOREIGN PATENT DOCUMENTS

JP 02-172549 7/1990

* cited by examiner

*Primary Examiner*—Gregory Huson
*Assistant Examiner*—Peter deVore
(74) *Attorney, Agent, or Firm*—Birch, Stewart, Kolasch & Birch, LLP

(57) ABSTRACT

A liquid supply nozzle having automatic shut-down and alarming function will stop feeding a liquid when a diaphragm is damaged with alarming the damage. The liquid supply nozzle can contain a press member under the diaphragm which pushes up the diaphragm and maintains an entire stoppage function to work even when the diaphragm is broken. The damage of the diaphragm can be visually inspected through a cap which is made of a substantially transparent material and visually or sonically perceived through an additionally provided alarm unit.

17 Claims, 4 Drawing Sheets

LIQUID SUPPLY NOZZLE

BACKGROUND OF THE INVENTION

1. Field of the Invention

The present invention relates to a liquid supply nozzle, and more particularly to a liquid supply nozzle stop which automatically stops the liquid supply when a predetermined amount of liquid is supplied.

2. Discussion of the Related Art

A known liquid supply nozzle, which can be used e.g. for supplying fuel from a fuel dispenser in a gas station or the like usually contains, a discharge pipe, a liquid feeding member, and a main valve which is provided between the discharge pipe and the liquid feeding member, an air passage which runs inside the discharge pipe and opens to the atmosphere on the wall of the discharge pipe around the tip thereof, a check valve which generates a negative pressure zone, and a valve open/close mechanism which holds the main valve open when the liquid should be fed and closes the same when a predetermined amount of liquid has been supplied.

The valve open/close mechanism has a diaphragm chamber which is in communication with the air passage normally open to the atmosphere and the negative pressure zone formed around the check valve, and the pressure state of the diaphragm chamber changes depending on whether or not the air passage opening is open. When the above-mentioned opening of the air passage tube on the discharge pipe is blocked by the liquid coming up to the level above the opening, the air passage does not open to the atmosphere, and then the diaphragm chamber is negatively pressurized through another passage from the negative pressure zone. In this way, the main valve, which is kept open by the valve open/close mechanism with a clutch, is closed by release of the clutch when the liquid has been satisfactorily discharged.

A diaphragm is held by being fixed on a rim of a hollow part provided in the nozzle main body, and has a rigid center plate fixed on its center for operating the clutch or the like. Accordingly, a part of the diaphragm where the center plate is fixed will become fatigued because of stress created by the movement of the valve open/close mechanism. The diaphragm in such a condition is easily damaged when a strong external force is applied thereto, for example, by the accidental dropping and subsequent impact of the nozzle on the ground, whereby the valve open/close mechanism does not properly work and the liquid is oversupplied.

In order to solve the above-mentioned drawback, it has been proposed to provide a liquid supply nozzle containing two sets of valve open/close mechanisms therein as disclosed in Japanese Kokai Publication 2 (1990)-172549. The provision of the two valve open/close mechanisms, however, makes the structure of the nozzle complicated and the manufacturing cost is increased.

OBJECT AND SUMMARY OF THE INVENTION

It is therefore an object of the present invention to provide a liquid supply nozzle with a supplemental function to assist a main automatic liquid supply stoppage function. The liquid supply nozzle comprises: an inlet; a discharge pipe having a free end; a main valve provided between the inlet and the discharge pipe; an air passage provided in the discharge pipe, the air passage having an opening in the discharge pipe adjacent the free end; a negative pressure forming member provided downstream of the main valve and forms a negative pressure zone; a valve open/close mechanism having a diaphragm chamber determined by a diaphragm member and a cap, the diaphragm chamber containing an urging member which presses the diaphragm member, the diaphragm chamber communicating with the air passage and the negative pressure zone, the valve open/close mechanism holding the main valve open, and closing the main valve by movement of the diaphragm member opposing the urging member when a predetermined amount of liquid is supplied; and a liquid supply backup operable when the valve open/close mechanism fails to close the main valve.

Another object of the present invention is to provide the liquid supply nozzle which has a supplemental liquid supply stoppage function when a main automatic liquid supply stoppage function does not appropriately obtained wherein the liquid supply backup of the present invention comprise a compulsory liquid supply suspension mechanism provided in the valve open/close mechanism and adapted to suspend liquid supply when the valve open/close mechanism fails to close the main valve.

A further object of the present invention is to provide the liquid supply nozzle with a relatively simple structure which prevents liquid from being oversupplied even if a diaphragm in the liquid supply nozzle is damaged wherein the compulsory liquid supply suspension mechanism is a press member provided at a space beneath the diaphragm member, the press member adapted to enlarge so as to move the diaphragm member opposing the urging member when the press member absorbs liquid leaked through the diaphragm member Still another object of the present invention is to provide the liquid supply nozzle which positively alarms when the valve open/close mechanism is damaged wherein the liquid supply backup further comprises an alarm unit connected to the press member which visually or sonically alarms leakage of liquid.

Yet another object of the present invention is to provide the above-mentioned liquid supply nozzle which is suitable for feeding or discharging a hydrocarbon-based liquid wherein the diaphragm member is made of an oil resistant material, and the press member is an absorption material which enlarges by absorbing a hydrocarbon-based liquid.

A still further object of the present invention is to provide the above-mentioned liquid supply nozzle in which damage of the diaphragm member can be visually recognized at an early stage, wherein the cap is made of a substantially transparent material permitting visual inspection of the diaphragm member.

A still further object of the present invention is to provide the above-mentioned liquid supply nozzle by which the material of the cap is transparent and suitable for the use wherein the material for the cap is selected from the group consisting of nylon resin and urethane resin.

A still further object of the present invention is to provide the above-mentioned liquid supply nozzle by which the liquid stoppage function can be still attained if a part of the diaphragm member is damaged even without swelling or enlargement of the press member, wherein the diaphragm member is composed of two sheets of rubber.

A still further object of the present invention is to provide the above-mentioned liquid supply nozzle, by which breakage of an upper one of two diaphragms is readily seen from outside of the nozzle through the cap covering the diaphragm member, wherein the two sheets of rubber are in different colors from one another at least on upper surfaces thereof.

A still further object of the present invention is to provide the above-mentioned liquid supply nozzle with a diaphragm member made of a sufficiently oil-resistant material with suitable mechanical properties, wherein the diaphragm member is made of nitrile-butyl rubber.

A still further object of the present invention is to provide the above-mentioned liquid supply nozzle with the liquid supply stoppage function when the diaphragm member is damaged, wherein a press member is in a ring shape and made of a material selected from the group consisting of ethylene-propylene rubber and chloroprene rubber.

A still further object of the present invention is to provide a liquid supply nozzle in which damage of a valve open/close mechanism, especially of the diaphragm member is easily perceived from outside of the nozzle, comprising: an inlet; a discharge pipe having a free end; a main valve provided between the inlet and the discharge pipe; an air passage provided in the discharge pipe, the air passage having an opening in the discharge pipe adjacent the free end; a negative pressure forming member provided downstream of the main valve and forms a negative pressure zone; and a valve open/close mechanism having a diaphragm chamber which is determined by a diaphragm member and a cap, the diaphragm chamber containing an urging member which applies a force to the diaphragm member, the diaphragm chamber communicating with the air passage and the negative pressure zone, the valve open/close mechanism holding the main valve open, and closing the main valve by movement of the diaphragm member opposing the urging member when a predetermined amount of the liquid is supplied, and the diaphragm member is visible through the cap.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

The liquid supply nozzle of the present invention possesses the liquid supply backup which complementary works when the valve open/close mechanism is damaged or does not function satisfactory.

The liquid supply backup can be mainly composed of a compulsory liquid supply suspension mechanism which backs up automatic shut-down of the liquid supply, and an alarm unit which visually or sonically indicates improper function or damage of the valve open/close mechanism. An example of the compulsory liquid supply suspension mechanism is a press member provided at a space beneath said diaphragm member.

Other feature of this invention will become apparent in the course of the following description of exemplary embodiments, which are given for illustration of the invention and are not intended to be limiting thereof.

Figure 1:
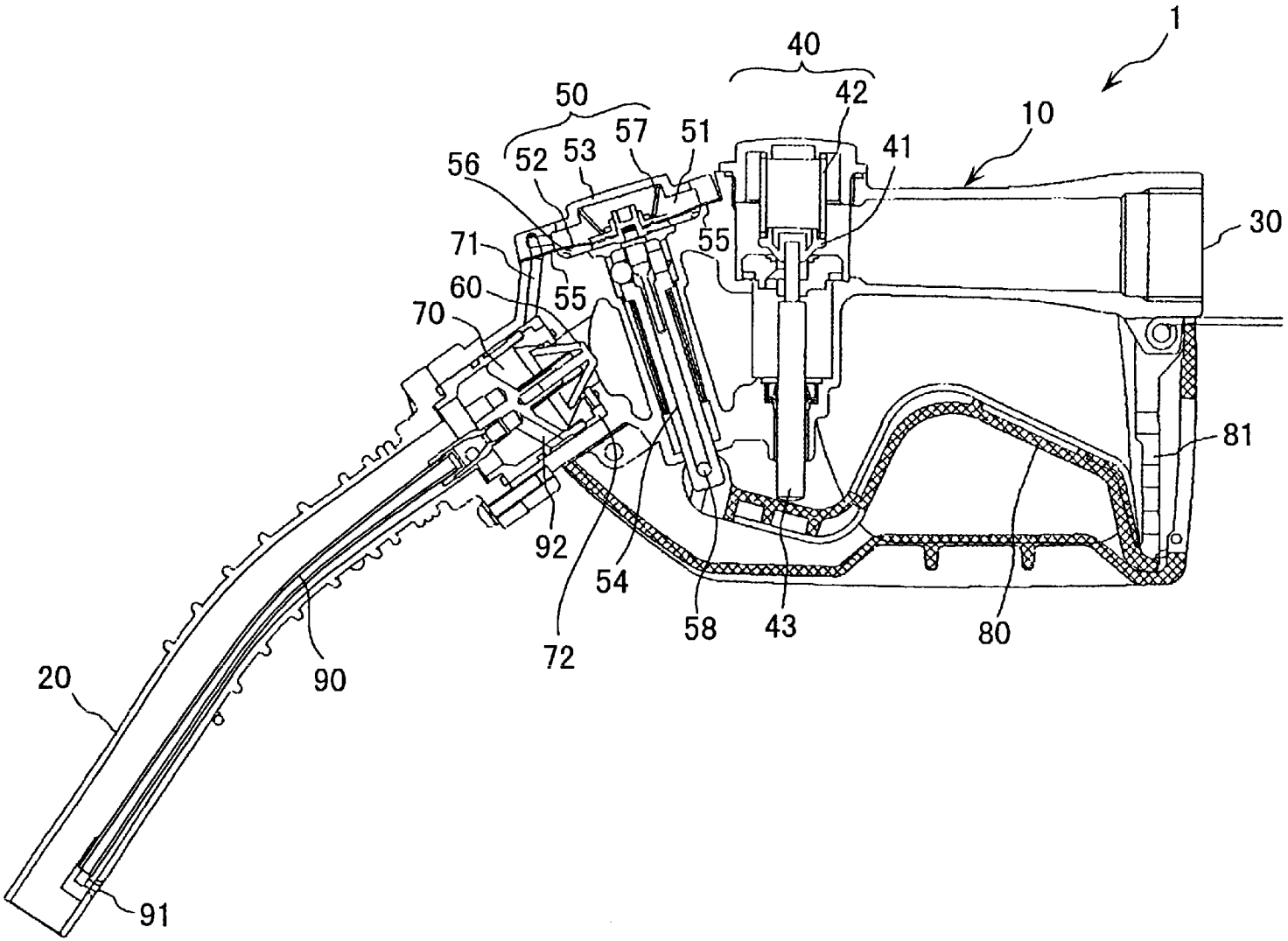
FIG. 1 is a cross-section for showing an embodiment of a liquid supply nozzle of the present invention.

FIG. 1 is a cross-section for showing an embodiment of a liquid supply nozzle 1 according to the present invention. A main body 10 of the liquid supply nozzle 1 has a discharge pipe 20 at one end, and an inlet 30 on the other end connecting with a liquid supply device (not shown) via a hose (not shown). In the nozzle main body 10, there are provided a main valve unit 40 mainly composed of a main valve 41 which is shown in a closed state. The closed state is achieved by an urging force of a valve spring 42 and a valve operation rod 43; and a valve open/close mechanism 50 which has a diaphragm chamber 51 determined by a diaphragm member 52 and a cap 53, and a function rod 54. The diaphragm member 52 is stretched across a rim 55 of a hollow part 56 in the nozzle main body 10 and urged by holding spring 57 in a lower direction. A liquid from the inlet 30 passes through the main valve 41 to a check valve 60 provided at the downstream, and the liquid passed through the check valve 60 flows into a channel 70 and then to the discharge pipe 20. When the liquid flows through the check valve 60, a negative pressure zone 72 is generated around the check valve 60.

In order for the liquid to flow, a lever 80, having one end connected to the function rod 54 to be rotated on a point 58, is gripped and actuated to open the main valve 41. The main valve 41 is maintained in an open state by the engagement between the other end of the lever 80 and a holding member 81.

An air passage 90 in the discharge pipe 20 extends from the nozzle main body 10 towards the tip of the discharge pipe 20. An opening 91 is provided on the discharge pipe 20 communicating with the air passage 90 at a part around the tips of the pipes 20 and 90. The air from the opening 91 comes up to the air passage 90 and reaches the diaphragm chamber 51 by way of a flow tube 92 in the nozzle main body 10. On the other hand, the diaphragm chamber 51 is communicated with the negative pressure zone 72 around the check valve 10 via a negative pressure communication passage 71.

As mentioned previously, when the lever 80 is pulled up by rotary movement at the point 58 together with the holding member 81, the valve operation rod 43 is pulled up and then the main valve 41 is opened. Thus, the liquid fed from the feeding port 30 flows out of the discharge pipe 20 passing through the main valve 41 and the check valve 60. When the liquid is discharged or flows, the diaphragm member 52 is maintained in a descent state (normal state) which is at the same level as when the valve is closed as shown in FIG. 1 since the diaphragm member 52 is being pressed by the holding spring 57 and exposed to the atmosphere by the opening 91.

When a container is fully filled with the liquid, the opening 91 is covered with the liquid and closed to the atmosphere, so that the position of the diaphragm 55 is raised up opposing the force of the holding spring 57. This is because the diaphragm chamber 51 communicates with the negative pressure communication passage 71. Therefore, the engagement of the lever 80 with the holding member 81 is disengaged, and the valve operation rod 43 is pressed down by the force of the valve spring 42. Consequently, the liquid feeding is suspended.

Figure 2A:
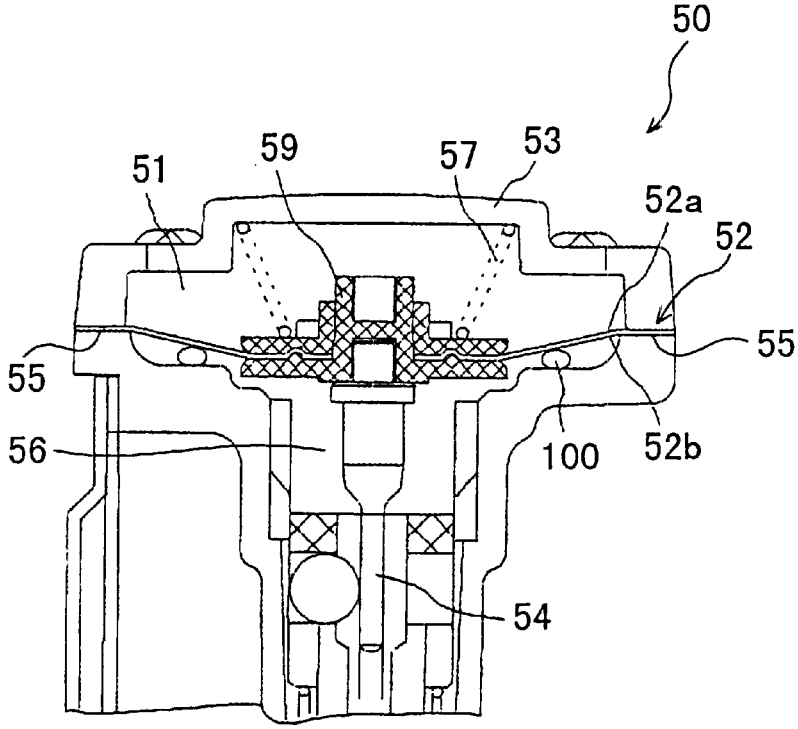
FIG. 2A is a fragmentary cross-section of a valve open/close mechanism for use in the present invention as an embodiment including a press member before enlargement thereof.

FIG. 2A is an enlarged fragmentary cross-section of the valve open/close mechanism 50 shown in FIG. 1. The diaphragm member 52 is composed of a first diaphragm plate 52*a*, and a second diaphragm plate 52*b*. The diaphragm chamber 51 is prepared in a liquid-tight manner by the provision of the diaphragm member 52, since the liquid to be fed is absorbed into the diaphragm chamber when the liquid feeding is completed and the opening 91 shown in FIG. 1 is closed. Therefore, it is necessary that the first and the second diaphragm plates 52*a* and 52*b* are prepared from a material which does not deteriorate when the liquid is in contact with the plates. For instance, the diaphragm plates 52*a* and 52*b* are preferably prepared from an oil-resistant material, such as a nitrile-butyl rubber. In this case, the liquid supply nozzle of the invention can be appropriately used for feeding a hydrocarbon-based liquid such as gasoline.

The periphery of the diaphragm member 52 is extended and fixed between the rim 55 of the hollow 56 and the cap 53 which are in contact with the diaphragm member 52 on the back side and the upper side respectively. The cap 53 for use in the present invention is preferably made of a material through which the valve open/close mechanism can be seen. Examples of the material for the cap 53 are high-molecular-weight materials such as nylon resin and urethane resin, which are substantially transparent to permit visual inspection of the diaphragm member 52 and have appropriate mechanical properties for use as the cap 53.

When the valve open/close mechanism, especially the diaphragm member 52 is damaged or broken, the damage is readily recognized through the cap 52. Thus, it is possible to repair the damaged or broken part at an early stage.

As mentioned previously, it is preferable to prepare the diaphragm member in a two layer structure. In this case, even if one diaphragm layer is damaged, the other diaphragm layer performs the stoppage function.

Furthermore, the two diaphragm plates can be colored differently at least on the upper surfaces of the plates. The breakage, especially of the upper diaphragm layer, can be clearly identified when seen through the cap 52, since the diaphragm layers are provided under tension and the differently colored part of the lower diaphragm layer is revealed from the torn part of the upper diaphragm layer. It is possible for a colored diaphragm layer to use a rubber material with a coating of a colored material, or to use a solid colored material.

In the hollow part 56 below the diaphragm member 52, a press member 100, for instance, in the form of a ring is inserted, which can be enlarged and increases in thickness by absorbing the liquid to be discharged.

The press member 100 works when the diaphragm member 52 is torn or damaged. Namely, even when the diaphragm member 52 is broken, the valve open/close mechanism 50 for use in the present invention still closes the main valve 41, since the press member 100 presses the diaphragm member 52 up by enlargement in height thereof by absorbing the liquid leaked from the broken part. This action is because the liquid comes up to the diaphragm chamber 51 when a required level of liquid is supplied as previously explained. It is preferable to employ the press member 100 in a ring shape, so that liquid leaked from the breakage can be absorbed at any point of the ring in contact with the liquid.

If hydrocarbon-based liquid is to be fed, it is preferable that the press member 100 is made of ethylene-propylene rubber or chloroprene rubber. Other materials can be used for the press member 100 as long as the material absorbs liquid to be fed and enlarges sufficiently to hold the diaphragm member up.

Figure 2B:
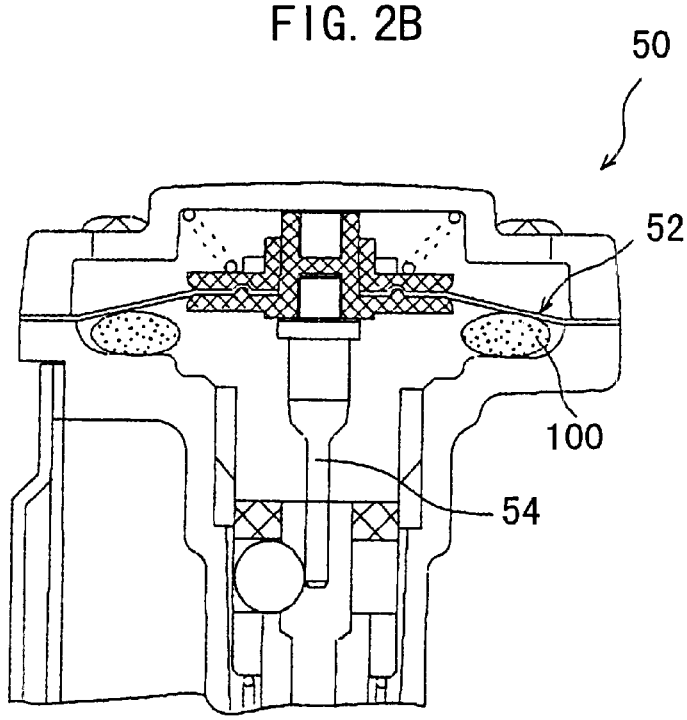
FIG. 2B is a fragmentary cross-section of the valve open/close mechanism including a press member which has been enlarged by absorbing liquid.

When the diaphragm member 52 is broken, the press member 100 absorbs the leaked liquid and enlarges as shown by a cross-section in FIG. 2B. The thickness of the press member 100 is determined so as to be able to push up the diaphragm member 52 opposing the holding spring 57 and to pull up the function rod 54 fixed to a center plate 59.

Thus, the function rod 54 pulls the lever 80 slightly upward, and then the lever 80 is disengaged from the holding member 81, whereby the valve operation rod 43 falls down with the aid of the valve spring 42. In this way, oversupply of the liquid is prevented.

Figure 3:
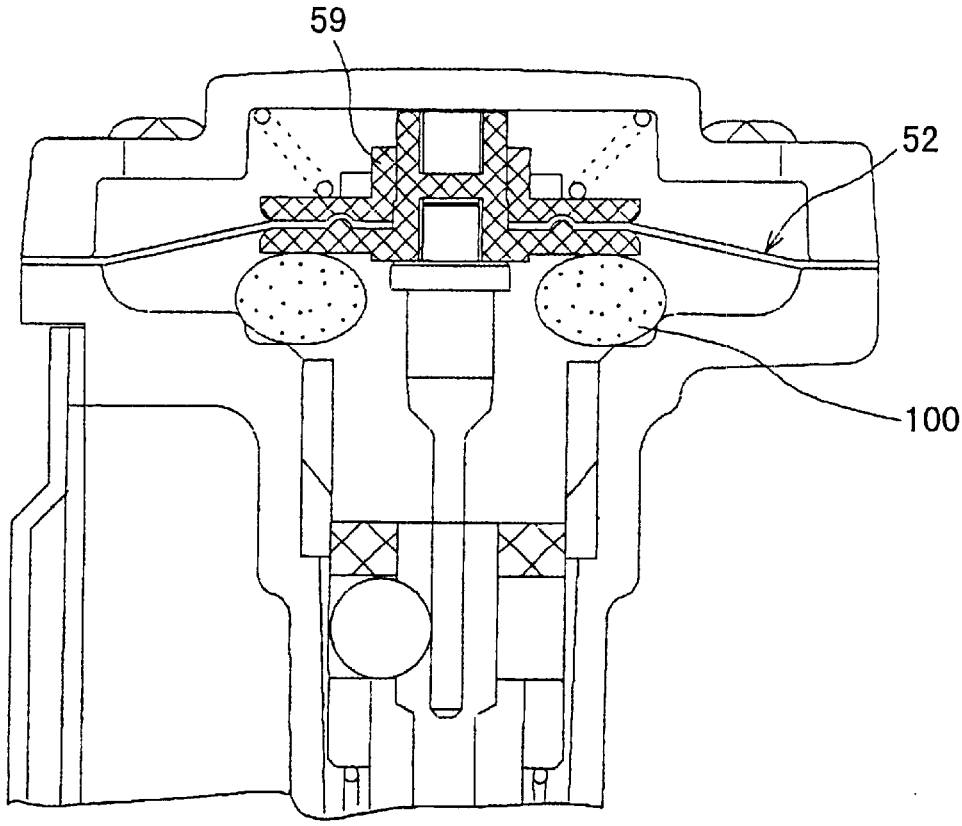
FIG. 3 is a fragmentary cross-section of a valve open/close mechanism for use in the present invention as a further embodiment when a press member has been enlarged.

FIG. 3 shows an enlarged fragmentary cross-section of another embodiment of the valve open/close mechanism 50. Unlike the valve open/close mechanism 50 shown in FIGS. 2A and 2B wherein the press member 100 is provided below the diaphragm member 52, it is possible to place the press member 100 immediately below a center plate 59. Also in this case, the press member 100 pushes up the center plate 59 and a diaphragm member 52 connected thereto when absorbs the liquid leaked from the diaphragm member 52.

Figure 4:
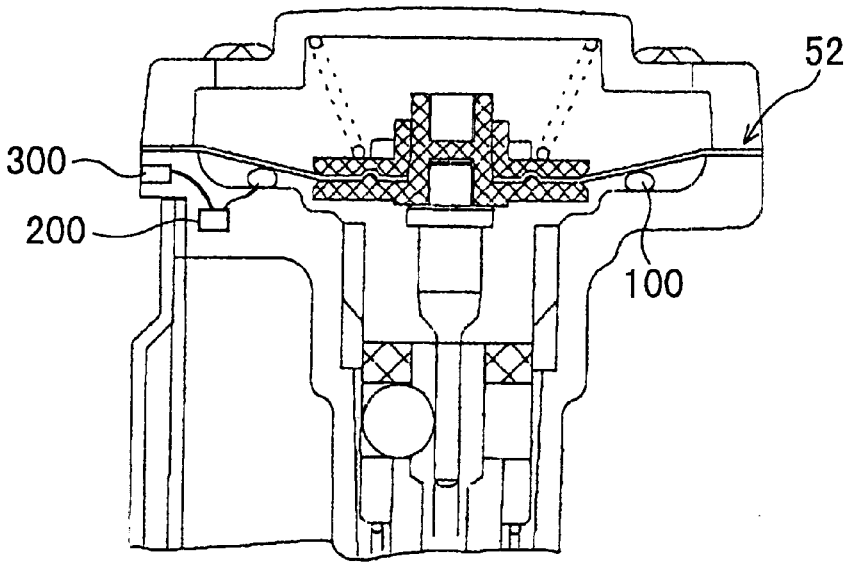
FIG. 4 is a fragmentary cross-section of a valve open/close mechanism with an alarm unit for use in the present invention as a further embodiment.

FIG. 4 is a fragmentary cross-section of a valve open/close mechanism with an alarm unit. The alarm unit is composed of a control unit 200 which is embedded in an appropriate part of the valve open/close mechanism and an alarm 300 placed at a visible part thereof. The control unit is connected to the press member. In this case the press member contains a conductive material such as carbon black or a metal therein, preferably in the form of particles.

Figure 5:
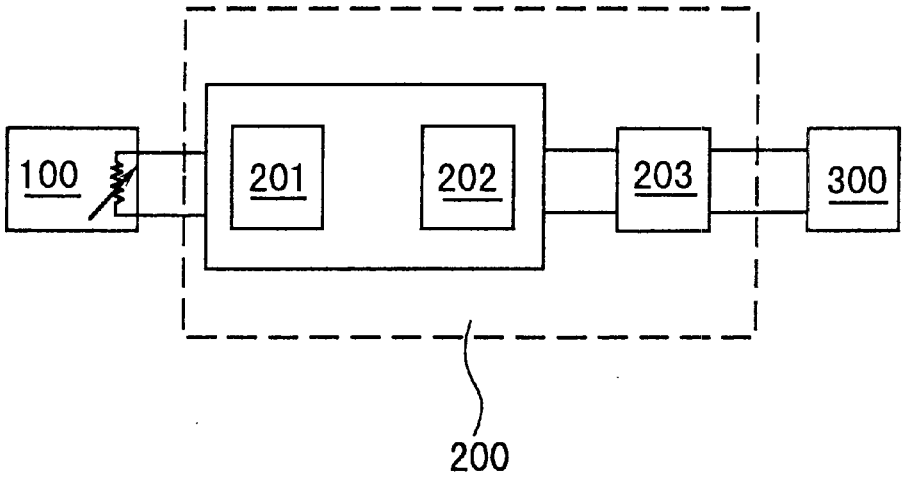
FIG. 5 is a circuit diagram for explaining the function of an alarm unit for use in the present invention.

As shown by a circuit diagram in FIG. 5, the alarm unit for use in the present invention functions depending on the electric resistance change of the press member. Namely, the press member containing the conductive material works as a variable resistance 100. When the diaphragm member 52 is broken and liquid is leaked therefrom, the press member is enlarged as explained above. The resistance of the press member is increased when the press member is expanded.

The resistance change is conveyed to a control unit 200 containing an amplification circuit 201, a judgment circuit 202 and a control circuit 203, which is then connected to the alarm 300. The change of resistance is indicated on the alarm 300 as sound or a visible sign such as flashing light or color change, for instance from blue to red. Consequently, when the diaphragm member is broken, the alarm 300 on the valve open/close mechanism sonically or visually alarms the breakage, with the main valve being closed by the enlargement of the press member.

As can be seen from the above, the liquid supply nozzle according to the present invention maintains a proper flow stoppage function by the compulsory shut down of the main valve by the provision of the compulsory liquid supply suspension system of the liquid supply backup even when the liquid supply nozzle loses the main automatic shut-down mechanism. This effect of the invention is very important from a safety aspect especially when the liquid supply nozzle is used for liquid, such as gasoline, which could be dangerous or cause environmental damage when the liquid is overflowed. Moreover, the environment can be kept clean since unexpected spills of liquid are prevented.

The liquid supply nozzle with the cap for the diaphragm chamber makes it easy to visually see damage of the valve open/close mechanism, mainly at the diaphragm member, so that it is possible to repair the broken part at an early stage before any possible accident.

A liquid supply nozzle is safely and effectively used when it is equipped with the press member and the transparent or translucent cap for the diaphragm chamber with the two diaphragm layers. Namely, damage especially of the upper diaphragm layer can be visually and/or sonically determined in the first place as an alarm of the breakage with the stoppage function normally performed by the other diaphragm layer; and in the second place, even when both of the diaphragm layers have some problems, the compulsory shutdown of the valve is performed by the function of the compulsory liquid supply suspension mechanism.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A liquid supply nozzle comprising:

an inlet;

a discharge pipe having a free end;

a main valve provided between said inlet and said discharge pipe;

an air passage provided in said discharge pipe, said air passage having an opening in said discharge pipe adjacent the free end;

a negative pressure forming member provided downstream of said main valve and forms a negative pressure zone;

a valve open/close mechanism having a diaphragm chamber determined by a diaphragm member and a cap, said diaphragm chamber containing an urging member which presses said diaphragm member, said diaphragm chamber communicating with said air passage and said negative pressure zone, said valve open/close mechanism holding said main valve open, and closing said main valve by movement of said diaphragm member opposing said urging member when a predetermined amount of liquid is supplied; and a liquid supply backup comprising a compulsory liquid supply suspension mechanism provided in said valve open/close mechanism and configured to suspend liquid supply when said valve open/close mechanism fails to close said main valve, said compulsory liquid supply suspension mechanism being a press member provided at a space beneath said diaphragm member, said press member being adapted to enlarge so as to move said diaphragm member opposing said urging member when said press member absorbs liquid leaked through said diaphragm member.

2. The liquid supply nozzle as claimed in claim 1, wherein said diaphragm member is made of nitrile-butyl rubber.

3. The liquid supply nozzle as claimed in claim 1, wherein said press member is in a ring shape and made of a material selected from the group consisting of ethylene-propylene rubber and chloroprene rubber.

4. The liquid supply nozzle as claimed in claim 1, wherein said liquid supply backup further comprises an alarm unit connected to said press member, said alarm unit visually or sonically alarms leakage of liquid.

5. The liquid supply nozzle as claimed in claim 1, wherein the diaphragm member is made of an oil resistant material, and the press member is an absorption material which enlarges by absorbing a hydrocarbon-based liquid.

6. The liquid supply nozzle as claimed in claim 1, wherein said cap is made of a material permitting visual inspection of said diaphragm member.

7. The liquid supply nozzle as claimed in claim 6, wherein said material for said cap is selected from the group consisting of nylon resin and urethane resin.

8. The liquid supply nozzle as claimed in claim 7, wherein said two sheets of rubber are in different colors from one another at least on upper surfaces thereof.

9. The liquid supply nozzle as claimed in claim 6, wherein said diaphragm member is composed of two sheets of rubber.

10. The liquid supply nozzle as claimed in claim 6, wherein said diaphragm member is in a two layer structure.

11. The liquid supply nozzle as claimed in claim 1, wherein said diaphragm member is a two layer structure.

12. A liquid supply nozzle comprising:

an inlet;

a discharge pipe having a free end;

a main valve provided between said inlet and said discharge pipe;

an air passage provided in said discharge pipe, said air passage having an opening in said discharge pipe adjacent the free end;

a negative pressure forming member provided downstream of said main valve and forms a negative pressure zone; and a valve open/close mechanism having a diaphragm chamber determined by a diaphragm member and a cap, said diaphragm chamber containing an urging member which applies a force to said diaphragm member, said diaphragm chamber communicating with said air passage and said negative pressure zone, said valve open/close mechanism holding said main valve open, and closing said main valve by movement of said diaphragm member opposing said urging member when a predetermined amount of liquid is supplied, and said diaphragm member is visible through said cap.

13. The liquid supply nozzle as claimed in claim 12, wherein the diaphragm member is made of an oil resistant material.

14. The liquid supply nozzle as claimed in claim 13, wherein said oil resistant material is nitrile-butyl rubber.

15. The liquid supply nozzle as claimed in claim 12, wherein said diaphragm member is composed of two sheets of rubber.

16. The liquid supply nozzle as claimed in claim 15, wherein said two sheets of rubber are in different colors from one another at least on upper surfaces thereof.

17. The liquid supply nozzle as claimed in claim 12, wherein said cap is made of a material selected from the group consisting of nylon resin and urethane resin.

* * * * *